United States Patent [19]

Conta et al.

[11] 4,130,752

[45] Dec. 19, 1978

[54] ELECTROTHERMAL PRINT HEAD

[75] Inventors: Renato Conta, Ivrea (Turin); Lucio Montanari, Cascinette (Turin); Riccardo Brescia, Ivrea (Turin), all of Italy

[73] Assignee: Ing. C. Olivetti & C., S.p.A., Ivrea (Turin), Italy

[21] Appl. No.: 823,658

[22] Filed: Aug. 11, 1977

Related U.S. Application Data

[60] Continuation of Ser. No. 675,352, Apr. 9, 1976, Pat. No. 4,055,743, which is a division of Ser. No. 512,564, Oct. 7, 1974, Pat. No. 3,967,092.

[30] Foreign Application Priority Data

Oct. 23, 1973 [IT] Italy ..... 70117 A/73

[51] Int. Cl.[2] ..... H05B 1/00

[52] U.S. Cl. ..... 219/216; 219/543; 346/76R

[58] Field of Search ..... 219/216, 543; 346/76 R

[56] References Cited

U.S. PATENT DOCUMENTS 3,960,255 6/1976 Bisson et al. ..... 346/76 R

*Primary Examiner*—C. L. Albritton

*Attorney, Agent, or Firm*—Schuyler, Birch, Swindler, McKie & Beckett

[57] ABSTRACT

A removably mountable electrothermal print head for writing dots-matrix characters while moving along a thermosensitive recording medium and a mounting for the hand or a movable carriage of a printer, the head comprises a plurality of electrically energizable resistive printing elements coated on a support; the outer surface of said elements is partly cylindrical with the generatrices in parallel relation with a common direction which is transversal with respect to the printing line of the recording medium. The print head is positioned with respect to the recording medium with the part-cylindrical outer surface of the resistive printing elements in tangential relation with the recording medium. The printing head is positioned on and removably fixed to the carriage by a manually actuatable latch.

5 Claims, 13 Drawing Figures

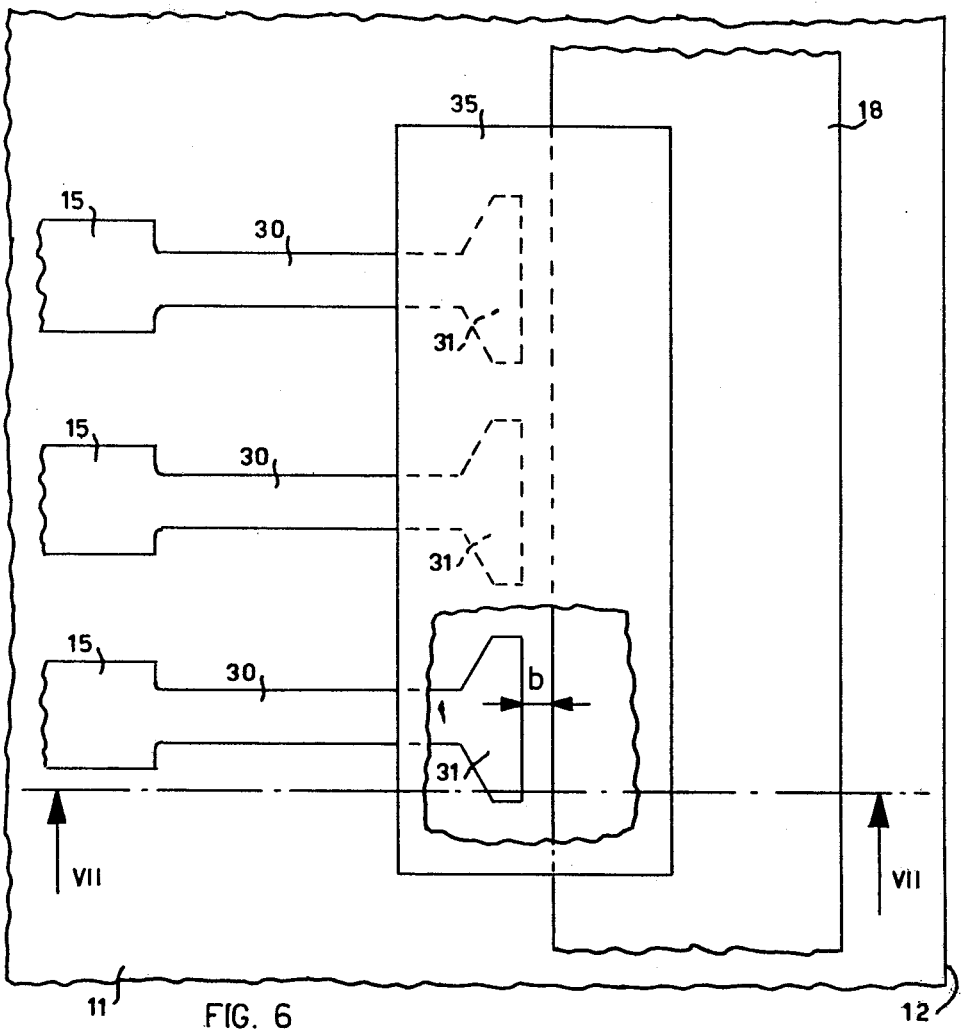
FIG. 6
FIG. 7
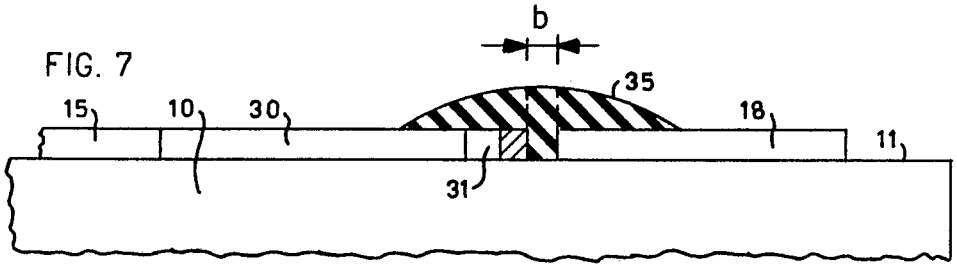

ELECTROTHERMAL PRINT HEAD

This is a continuation, of application Ser. No. 675,352, filed Apr. 9, 1976, now U.S. Pat. No. 4,055,743, which application was a division of Ser. No. 512,564 filed Oct. 7, 1974, now U.S. Pat. No. 3,967,092.

BACKGROUND OF THE INVENTION

1. Field of the Invention

The present invention relates to a removably mountable electrothermal printing head for non-impact printing and to the mounting for positioning it on the moving carriage of a printer. Such a head is designed to produce, in response to ingoing electrical impulses, visible imprints on a recording medium which is electrically insulating and heat sensitive.

2. Description of the Prior Art

For effective utilization of the speed of modern systems of electronic information handling, it is essential to have available peripheral high-speed printing units, and it is also desirable that such printing units should be fairly noiseless, since they are normally located near the user, in offices or other working sites. While the use of printing devices depending on the ballistic impact of a character-bearing member against an inked ribbon in contact with the recording medium often involves speed limitations intrinsic to the system of mechanical actuation of the character-bearing member, with noise levels often reaching the limits of tolerability, introduction of impactless printing devices removes the above-mentioned drawbacks of noisiness and slowness.

Impactless printing devices are known which utilize the method of electrothermal printing. For example, U.S. Pat. No. 3,596,055 relates to an electrothermal printing unit having a printing head with a matrix of points or printing elements for generating characters to be printed. The matrix is composed normally of 35 elements, i.e. of five columns evenly spaced over the width of the character, each containing seven elements, the seven elements of each column being also evenly spaced over the height of the character to be printed. The elements are heated by resistances incorporated in them when they are subjected to an electrical potential difference.

Printing takes place character by character, a selection and control circuit providing for electrical excitation and heating only those points of the matrix required to form the character that is to be printed.

According to the patent above-mentioned, the operation of printing is performed with a head fixed relative to the recording medium, and consists of pressing the head, with the printing points warm, on to the heat-sensitive recording medium. This operation is therefore similar to a hot-stamping operation, and the imprint of each point on the recording medium is substantially the same size as the printing points. The movement of the head along a printing line is therefore intermittent, with a number of halts equal to the number of the characters constituting a line of print. These halts, however brief and alternating with very rapid movements from one printing position to the next, contribute intrinsically to slowing down the printing speed.

Another method of printing by points of the electrothermal type, to which reference is made in our U.S. Pat. No. 3,777,116, consists of using an electrothermal head having a single column of seven elements regularly spaced over the height of the character to be printed; the height of each of these printing elements is that of the printed point which it is desired to obtain on the recording medium, while the width of each element is much less than that of the printed point. This permits the head to move continuously along a line of print, the printed point resulting from the combined action of heating the printing element and from the movement of the latter.

Now if we consider a configuration of characters of the kind of those obtainable with a matrix of $7 \times 5$ elements such as those described, this latter head generates each character by five elementary printing acts, a control and selecting circuit taking care of actuating, with the required delays, the elements required for printing the desired character.

Although in comparison with the method described in the aforesaid U.S. Pat. No. 3,596,055 an increased number of elementary printing acts is required to form the characters, this last method permits higher printing speeds, since the head moves rapidly and without any interruption along a line of print. In addition, the arrangements for moving the head are considerably simplified, since a step-wise movement is no longer necessary.

The device of U.S. Pat. No. 3,777,116 has, however, some drawbacks relating to the individual printing elements and fitting them into a single head. The elements are composed of graphite and are built into a rectangular body connected to the control and piloting circuit; on a tapered portion is formed the printing surface. The elements are fitted in a single head, with the printing surfaces in contact with a ribbon of metallic material, supported by the head, which constitutes the common return line for the actuation circuits of all of the printing elements. The head is positioned so that the metallic ribbon is in contact with a heat-sensitive recording medium.

The contact resistances between the printing surfaces of each element and the metallic ribbon, the particular dimensions of the printing elements and finally the material used, all contribute to a considerable increase in the electrical power required for activation of the printing elements.

Moreover in thermal printers normally the thermal printing head is fixedly secured to the carriage which moves the head along a printing line of the recording medium; therefore the replacing of said head owing to break or wear thereof is generally an operation that cannot be carried out by the user but requires the call of skilled personnel as, normally, it involves unscrewing and securing screws, to disconnect electric connections and to restore them when the replacing operation is carried out and, finally, to adjust the head position with respect to the printing medium by means of suitable adjusting devices.

Furthermore, the use of a head fixedly mounted on the carriage does not confer thereon any flexibility about the printing character format for the user, namely it does not allow the user to select, for instance, inclined characters by the immediate positioning of the suitable head on the displacing carriage of the printer.

SUMMARY OF THE INVENTION

A first object of the present invention is to therefore provide an electrothermal printing head with a single column of printing points designed for printing while continuously sliding along a recording medium, in which the dimensions and the shape of the printing points are such that they permit higher printing speed, better definition of the printed points and at the same times reduce the electric power required for excitation of the printing points.

A second object of the invention is to provide a device for positioning and removably fixing a head according to the first object of the invention on the carriage which moves said head along a printing line of the recording medium.

In accordance with the first object of the invention there is provided an electrothermal printing head for effecting impactless printing on heat-sensitive recording means, comprising an electrically insulating support carrying a plurality of individually energizable resistive printing elements and a pattern of conductors contacting the elements and by way of which the elements can be selectively energized, wherein each element comprises a region of resistive material which has a part-cylindrical outer surface concave towards the support, the generatrices of the part-cylindrical outer surfaces of all regions being parallel to a common direction.

According to the second object of the invention guiding means are provided for positioning the head on the carriage of the printer, and resilient reversible locking means are provided for fixing the positioned head; a plurality of electric contact assembled on said carriage being suitable to contact the conductors of the head when the positioning and locking operations are carried out the resilient reversible locking means being rendered ineffective manually when the head is removed from the carriage.

The invention will be described in more detail, by way of example, with reference to the accompanying drawings.

BRIEF DESCRIPTION OF THE DRAWINGS

FIG. 6 is an enlarged detail of a front view of an electrothermal head according to the invention, in a second embodiment;

FIG. 7 is a section along line VII—VII of FIG. 6;

FIGS. 2, 3, 4 and 5 relate to a first embodiment of a thermographic head according to the invention. The head comprises a support 10 (FIG. 2) in the form of a rectangular plate, on a planar face 11 of which, near a side 12, are deposited seven resistance elements 13 aligned parallel to the side 12, each having the base in contact with the face 11. Each base is substantially rectangular (FIG. 4), with a short side 14 parallel to the side 12. The surfaces of the resistance elements 13, opposite to the base in contact with the face 11, have a part-cylindrical form with the generatrices parallel to the side 14 and the concavity turned towards the base in contact with the face 11 (FIG. 5).

Figure 1:
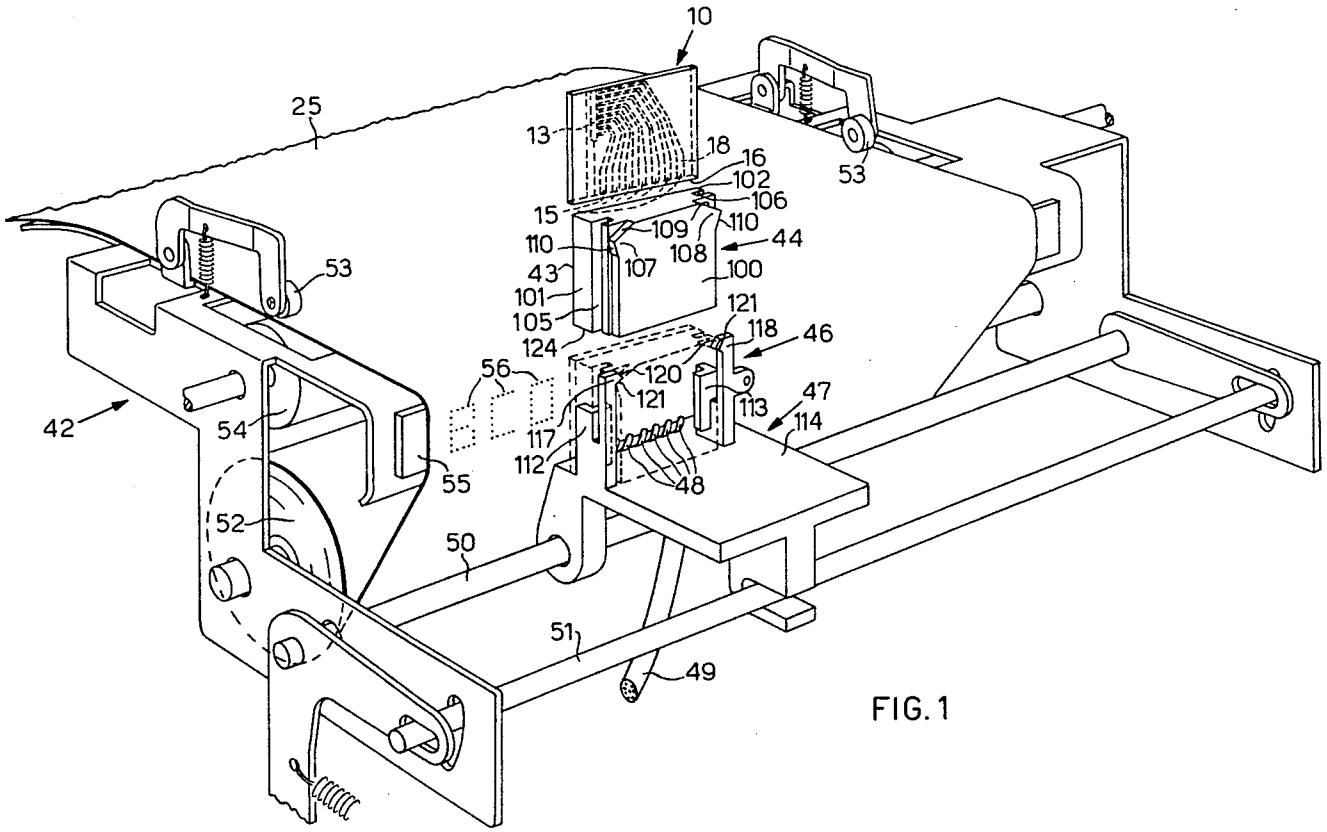
FIG. 1 is an exploded perspective view of a printer using an electrothermal head and a device for removable fixing it embodying the invention.

Seven feed conductors 15 (FIG. 2) deposited on the face 11, one for every resistance element 13, extend substantially parallel to each other and suitably spaced, from the side 16 adjacent to the side 12 until they contact the resistance elements 13 (FIG. 4) along the dimension 14 of these latter, extending part way under the base.

Seven return conductors 17, deposited on the face 11 extend perpendicular to the side 12 and are in contact, at one end, with the resistance elements 13 along a line of contact parallel to the side 14, and at the other end with a common conductor 18, also deposited on the face 11, which extends parallel to the side 12 (FIG. 2) as far as the side 16. Again the conductors 17 partly underly the bases of the elements.

Figure 2:
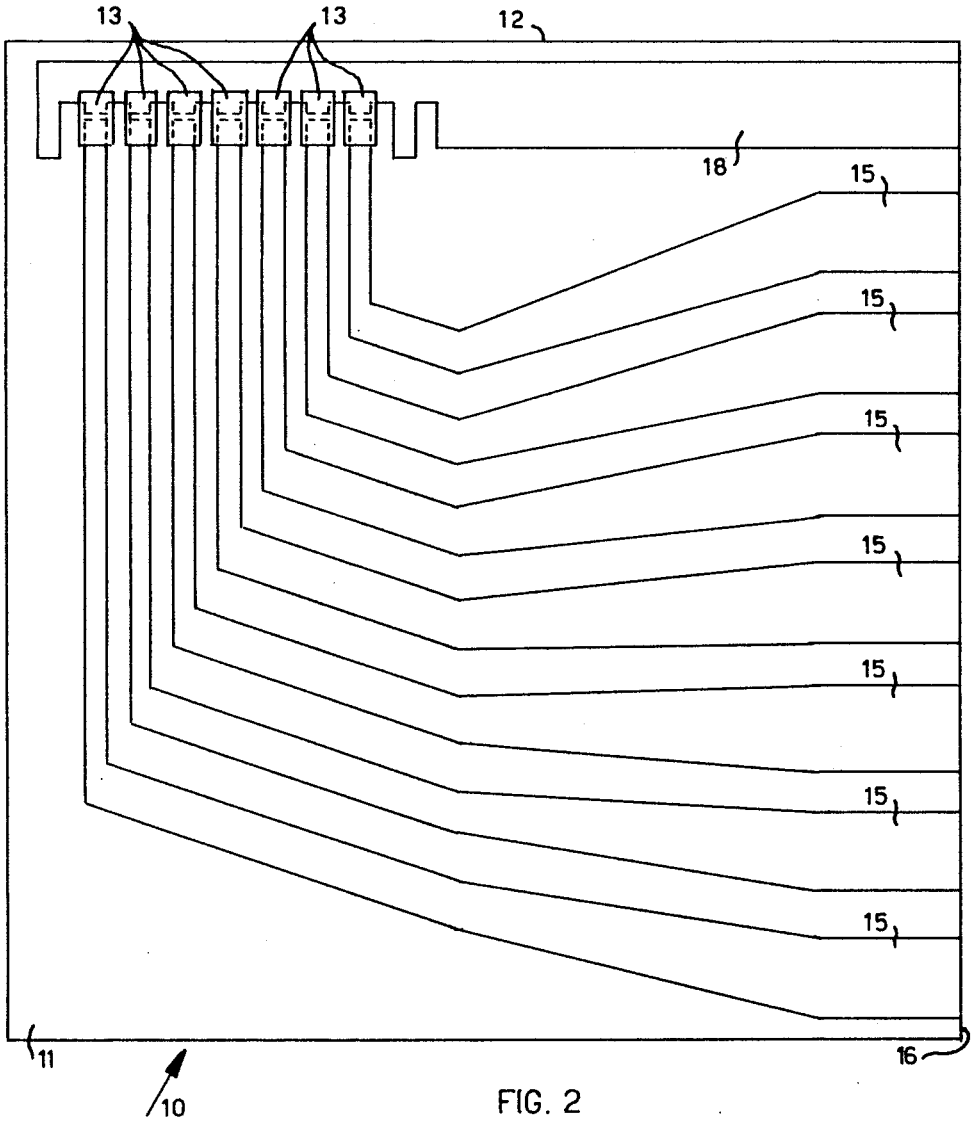
FIG. 2 is a front view of an electrothermal head according to the invention, in a first embodiment.
Figure 4:
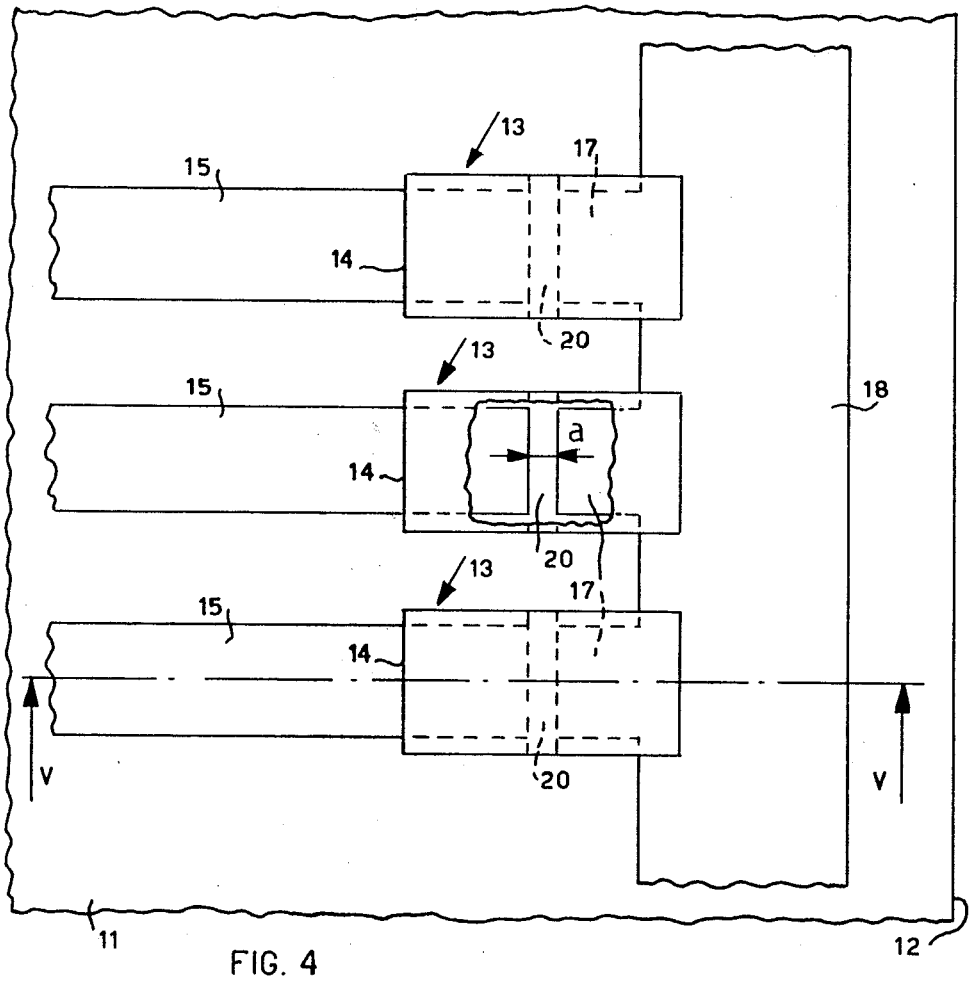
FIG. 4 is an enlarged detail of FIG. 2.
Figure 5:
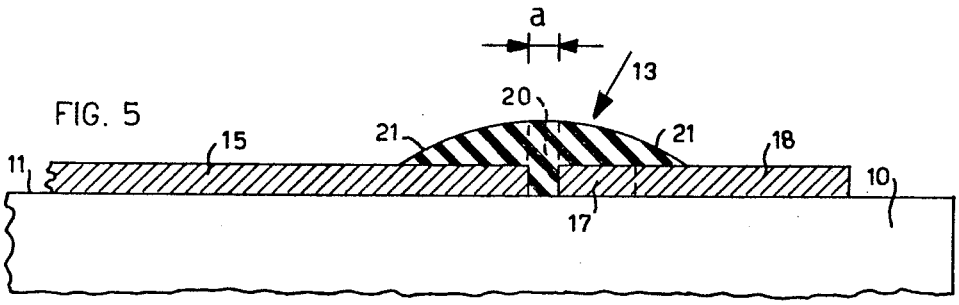
FIG. 5 is a section along line V—V of FIG. 4.

The technique for obtaining such a deposit of resistance elements and conductors on the face 11 can be one of the many known in the art; as a preferred example the thick film technique may be cited to which particular reference is made in connection with FIGS. 2, 4 and 5 of the present description. Using this technique, the conducting layers 15, 17 and 18 are first deposited by means of thick film conducting pastes, such as for instance, gold, silver-palladium, or gold-palladium, according to the configuration shown in FIG. 4, i.e. leaving a gap of a few tenths of a micron between each feed conductor 15 and the corresponding return conductor 17. In this way, there are formed on the face 11 seven rectangular zones 20, not covered with conducting material and interposed between a feed conductor 15 and the corresponding return conductor 17, which are aligned with side 12 of the face 11 and have dimensions equal to the width of the feed and return conductors of the said zones (of the order of hundreds of microns), and to the width of the gap a.

In each zone 20 there are then deposited, using thick film techniques, further layers of thick film resistance paste, as for example, oxides of bismuth and ruthenium, or noble metals, in order to obtain the resistance element 13 of the required thickness and cross-section.

By suitable control of the operations of depositing the resistive layers, it is possible to obtain the outer surface of the resistance elements 13 with the curvature described above. Deposition of the resistive layers leads to spreading of the resistance paste beyond the above-mentioned zone 20 above the conducting layers 15, 17 and 18, forming portions of the resistance elements 13 which, at least from the electrical aspect, are completely short-circuited by the underlying conducting layers 15, 17 and 18. The only portion of the element 13 electrically activable is that deposited in the above-mentioned zone 20 and delimited by the hatched lines in FIG. 5.

Within the limits above described, the dimensions of the zone 20 and of the conducting layers 15, 17 and 18 may vary at discretion. In practice, good results of low electricity consumption, better definition of the printed characters and higher printing speed, have been obtained with conducting layers of thickness 7–10$\mu$ and widths of 200$\mu$ in the proximity of zone 20, and with a gap width of about 50$\mu$.

The distance between one resistance element and another depends on the height of the character to be printed and the necessity for maintaining good electrical insulation between each resistance element 13 and the next. For printing characters with a height of 2.54 mm a distance of about 200μ provides satisfactory results. The function of the resistance elements 13 is to produce heat in zone 20 as a consequence of the passage of an electrical current through them, thus generating a "hot point" having the dimension of the zone 20. Therefore the resistance of these resistance elements must be at least an order of magnitude greater than that of the corresponding conductors. In practice it is found that a resistance of about 60 to 100 ohms is sufficient for heating to a temperature of 150°–200° C. with a current of 150 to 200 mA.

FIGS. 6 and 7 show a second embodiment for the resistor elements of the electrothermal head according to the invention. FIG. 6 is an enlargement of the zone of the face 11 of the plate 10, adjacent to the side 12, while the configuration of the conductors 15 in the remaining part of the face 10 is identical with that seen in the first embodiment. In this zone on the other hand, differing from what is described in the first embodiment, the conductors 15 show a first portion of reduced width 30 so that their relative distance is increased compared with the first embodiment, and an adjoining end portion 31 in which the width of every conductor is increased compared with that of the portion 30 and also compared with that of the corresponding portion in the first embodiment: in fact it is about 300μ, while the corresponding distance between the conductors 15 becomes, in these terminal portions, about 100μ. The terminal portions 31 of the conductors 15 face the conductor 18 deposited on the face 11, separated from it by a gap b equal to 50μ and extending parallel to the side 12 as far as the side 16 of the face 11.

A strip 35 consisting of several layers of thick film resistor paste is deposited above the terminal portions 31 and the conductor 18 parallel to the side 12 and over the whole zone concerning the conductors 15. The strip 35 has the surface which is not in contact with the face 11 part-cylindrical with the concavity turned towards the face 11 (FIG. 7) and the generatrices parallel to the side 12.

When a potential difference of a suitable value is applied between one of the conductors 15 and the conductor 18 there circulates, in the circuit composed of these conductors 15 and 18 and the resistor zone included between them, an electric current which heats up the zone included between the terminal portion 31 of the excited conductor 15 and the common return conductor 18, thus defining, as in the first embodiment, a "hot point" substantially rectangular in form with dimensions approximately equal to the width of the terminal portion 31 and to the width of the gap b.

The arrangement of the conductors 15 is such as to prevent undesired heating of the parts of the resistor strip adjacent to the thermally excited part. Compared with the first embodiment this avoids physical separation of the resistor elements 13 while ensuring the required thermal insulation between portions of the strip 35 included between different conductors 15.

Figure 3:
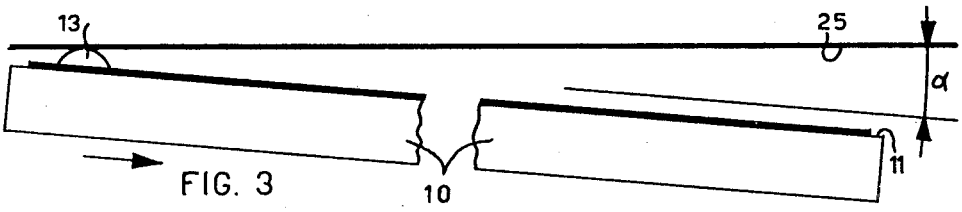
FIG. 3 is a plan view of the head of FIG. 2.

As stated above, the head is designed for printing characters with matrices of points, in elementary printing acts during each of which a column of the character is printed on a recording medium in continuous relative movement with respect to the head during the printing operation. A heat-sensitive recording medium 25 (FIG. 3) may, for example, be composed of treated paper consisting of a normal sheet of paper acting as support, covered with a layer of heat-sensitive material having the property of changing colour when it is raised to a temperature above a certain threshold characteristic of the material in question. The initial and final colours depend both on the paper support and on the heat-sensitive material coating it. In general it is preferred to have a very light initial colour and a very dark final colour in order to get a good contrast in the print-out. Another recording medium can be represented by a heat-transferable inked ribbon of known type, interposed between the head and a sheet of ordinary paper on to which ink transfer occurs by selective heating of the ribbon. For printing, the head is positioned for example on a sheet 25 of heat-sensitive paper of the above-described type, in such a way that the column of resistor elements 13 or the resistor strip 35 is in contact with the paper and perpendicular to a line to be printed (FIG. 3). The overall length of the column of the seven resistor elements 13 or of the strip 35 thus determines the height of the character to be printed. By using the support 10 in the form of a rectangular plate as shown in FIGS. 2 and 3 the electrothermal head can also be positioned so that the plane of the face 11 of the plate 10 makes with the plane of the paper an angle $\alpha$ of a few degrees, from 0.5° to 2.5°. This inclined position is desirable to prevent the head from catching on the sheet, as could happen if the head were kept with the face 11 parallel to the plane of the paper, since the thickness of the resistive paste which separates the face 11 from the sheet 25 is anyhow very little, normally less than 60μ. The inclination of the head relative to the heat-sensitive paper is not however essential, since it is a consequence of the type of support used for the conducting and resisting deposits.

Figure 8:
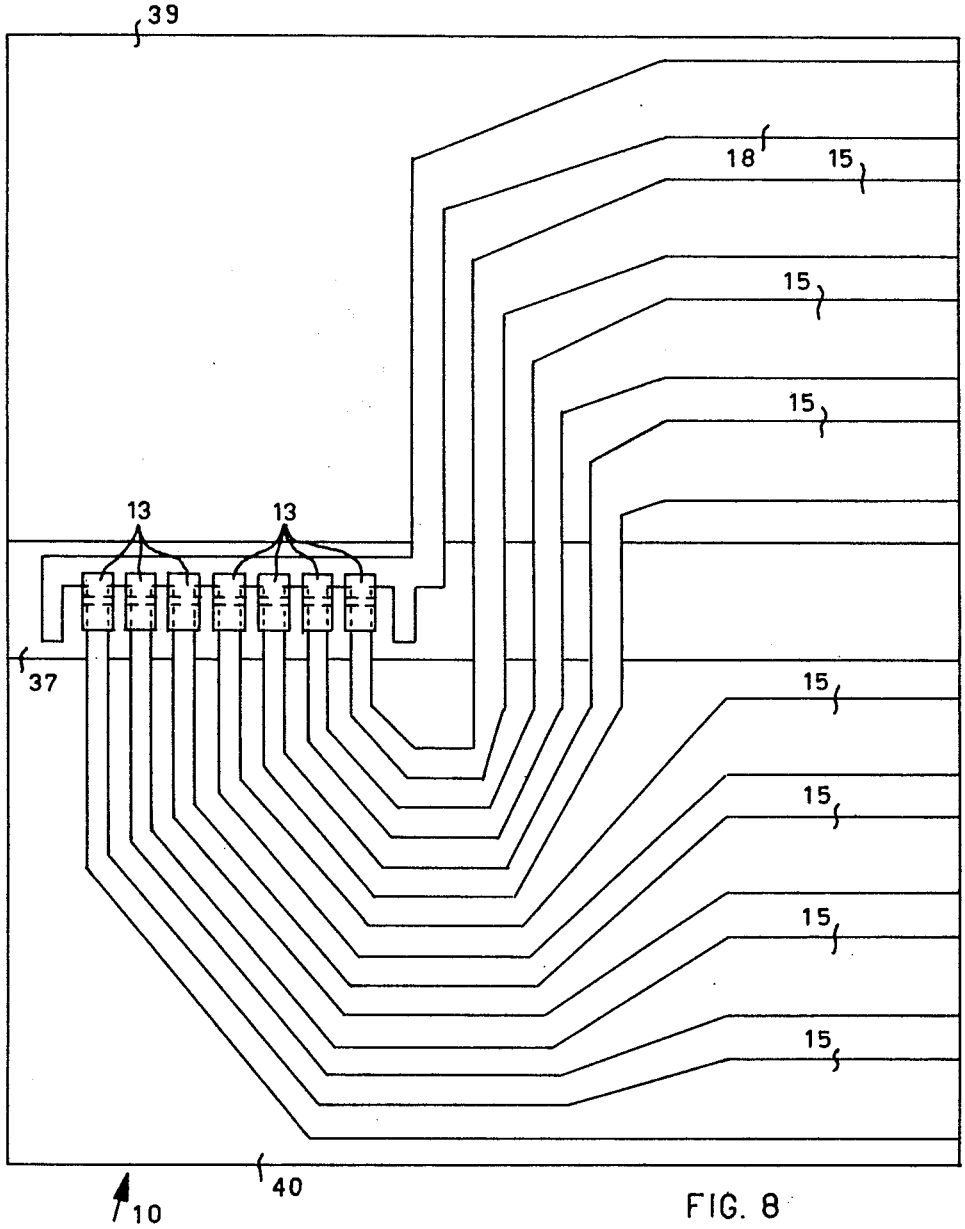
FIG. 8 is a front view of a head according to the invention, in a third embodiment.
Figure 9:
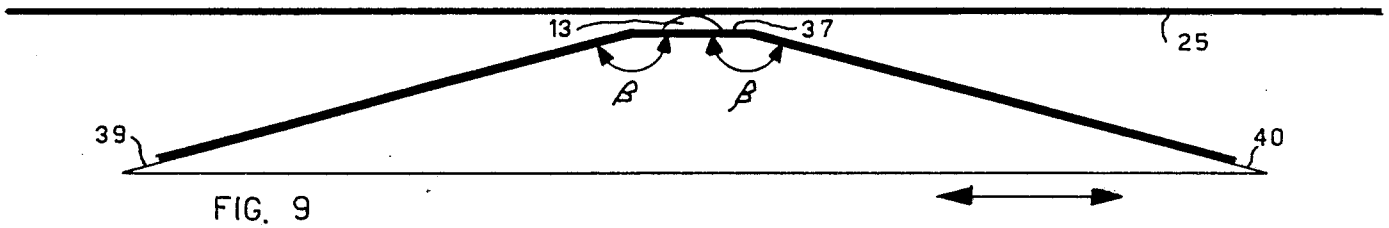
FIG. 9 is a plan view of the head of FIG. 8.
Figure 10:
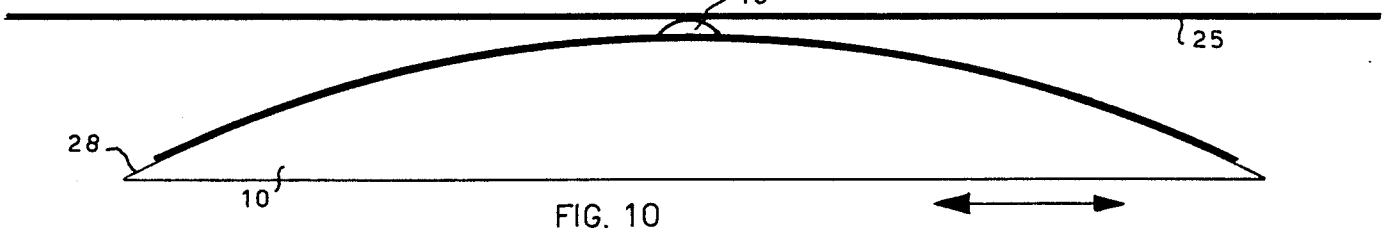
FIG. 10 is a plan view of a head according to the invention, in a fourth embodiment.

In FIGS. 8, 9 and 10 are shown two examples of embodiments of the thermographic head in which the support is such as to prevent the possibility of catching on the recording medium, and which in addition permit sliding and two-directional printing on the medium without inclining the support relative to the recording medium.

In FIGS. 8 and 9 the support 10 has a trapezoidal section with the obtuse angles $\beta$ between the minor base and the oblique sides (FIG. 9) a little less than 180°. The resistor elements 13, or the resistor strip 35, and the end portions of the conductors 15 and 18, are deposited according to the geometry of FIGS. 5 and 6 on the face 37 corresponding to the minor base and having a width little greater than the width of the resistor elements 13, while the conductors 15 and 18 extend on the faces 39 and 40 corresponding to the oblique sides of the section of the support 10. The head is positioned relative to the plane of the registration medium 25 as indicated in FIG. 9, i.e. with the surface 37 parallel to the registration medium.

In FIG. 10 the support 10 has a part-cylindrical surface 28 with its generatrix perpendicular to the plane of FIG. 10; in such a case the resistor deposits 13 are produced on the top of the surface along the generatrix. The conductors 15 and 18 extend suitably spaced on the surface 28. The head is positioned relative to the recording medium as indicated in FIG. 10, with the plane of the recording medium 25 in contact with the resistor elements 13 and with the curved surface 28 substantially tangent to the recording plane.

Whichever type of support is used, contact between the resistor elements 13 or the strip 35 and the heat-sensitive sheet of paper 25 occurs, because of their curved surfaces, along a tangent line (theoretically only a line) perpendicular to a print line and hence to the direction of movement of the head along the paper. In practice this tangent line has a finite width of less than 50μ, i.e. smaller than the width of the zone 20 (gap a) of the resistor elements 13 or the gap b of the strip 35. The feed conductors 15 and the common return conductor 18 are connected to a selector and control circuit designed to energize electrically, and hence thermally, during the movement of the heat relative to the paper, those elements in the column of resistor elements 13 required for formation of the character to be printed. This circuit can be similar to that described in our patent aforementioned and will therefore not be described in what follows.

The use of a "hot point" of the type described above permits a considerable increase in the velocity of sliding of the head across the paper, without however having recourse to very short excitation times which could lead to results difficult to control. Having decided on the width of the printing "hot point" and that of the printed point that is to be obtained (normally the printed point is square and hence its width corresponds to the height of the printing "hot point") it is in fact evident that increasing the velocity of sliding the head across the paper implies a corresponding diminution of the time of thermal excitation of the "hot point" during such movement in order to obtain a printed point with the required dimension, but it is however not possible to limit the excitation time below a certain value corresponding to the thermal inertia of each resistor element 13, i.e. the time required for altering its temperature from a value above the threshold to a value below it and vice versa. The thermal inertia is in general a function of the dimensions of the body to be heated, and hence the fact of having constructed a resistor element 13 with the above-mentioned characteristics, i.e. heated parts of minimal dimensions and making tangential contact with the recording medium, results in the double advantage of reduced thermal inertia and the possibility, even at high sliding velocities, of using relatively long excitation times resulting in greater definition and coloration of the printed point. Given also the values of resistance and current involved, the result is that the electric power required for energizing the resistor elements is reduced to very low values, of the order of 2 to 4 watt, i.e. low enough to permit power supply from batteries.

Figure 13:
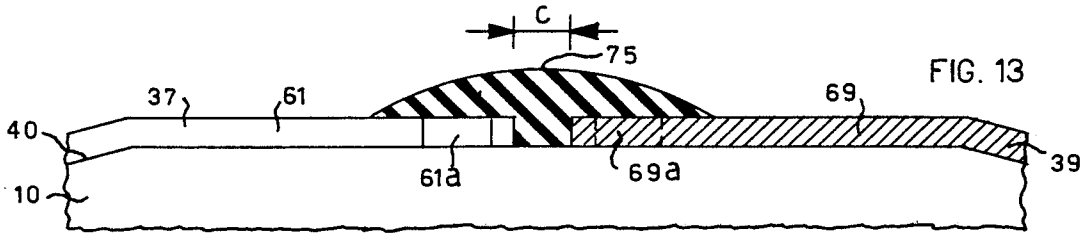
FIG. 13 is a section along line XIII—XIII of FIG. 12.
Figure 11:
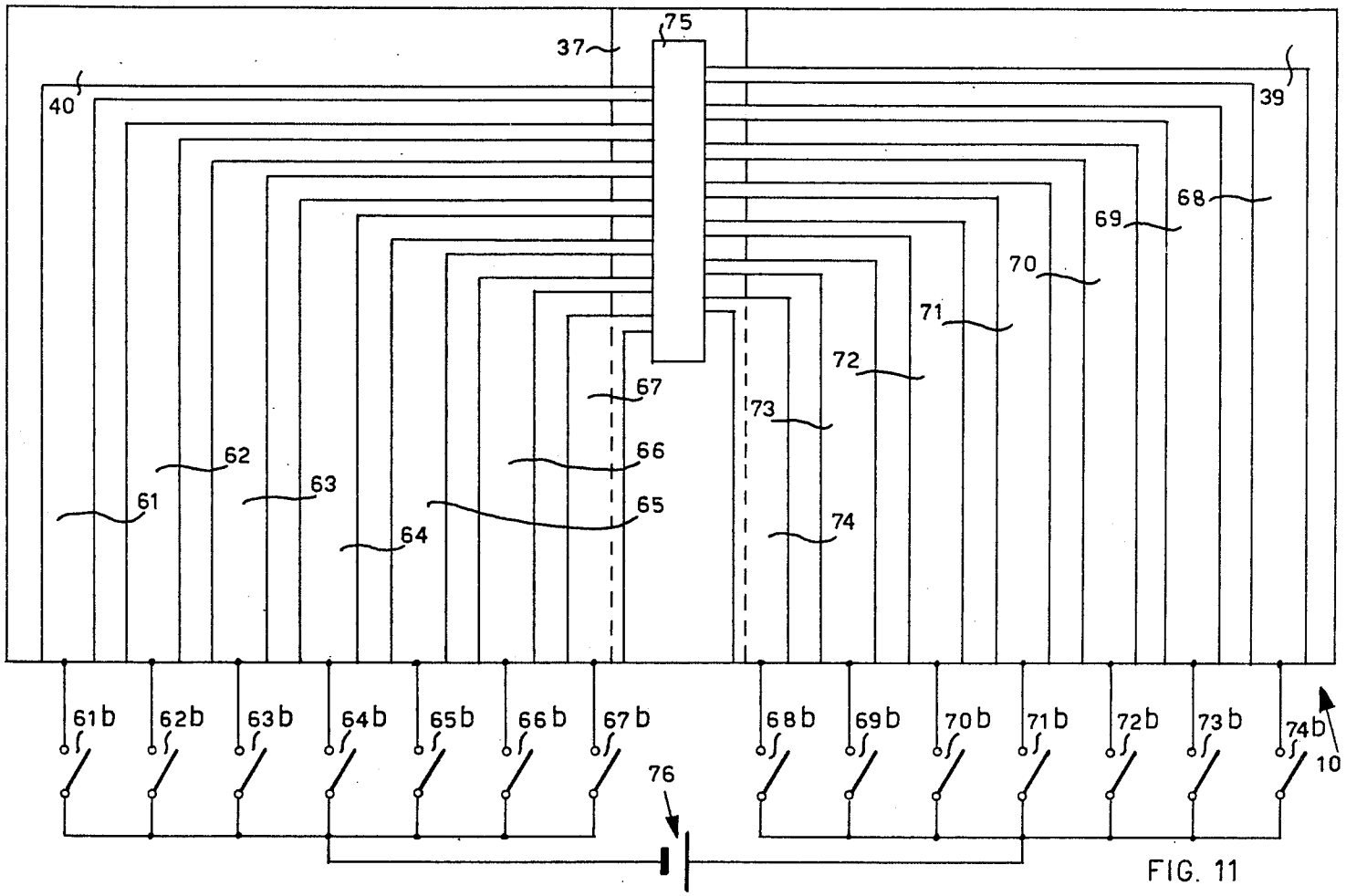
FIG. 11 is a front view of an electrothermal head according to the invention, in a fifth embodiment.
Figure 12:
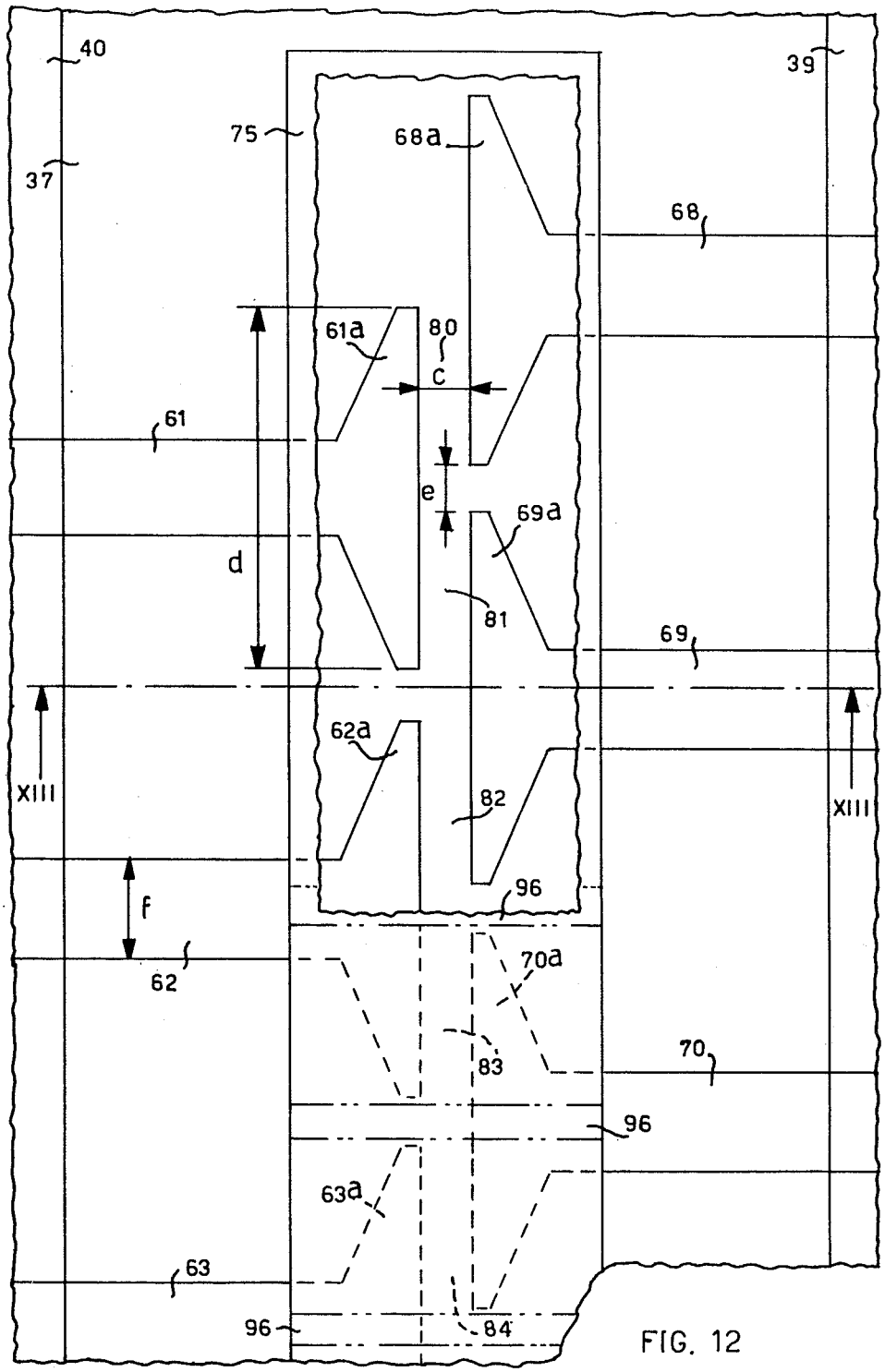
FIG. 12 is an enlarged detail of FIG. 11.

In FIGS. 11, 12 and 13 there is shown a further embodiment of the thermal head according to the invention, in which the same precision of deposition of the conductor and resistor layers is maintained, which, thanks to a different geometry of the electrodes and feed conductors allows about twice as good definition as that obtainable with the previous embodiments, more precisely, to obtain on the same height of the character, a column of 13 "hot points" or printing points which can be individually selected. An arrangement of this kind, however, evidently requires a selection and control circuit designed for selective feeding of 13 instead of seven hot points. With reference to FIG. 12, on a support 10 trapezoidal in section, of the type illustrated in FIG. 9, there are deposited by the thick film technique a first and a second group of seven conductors respectively 61 to 67 and 68 to 74, spaced regularly on each of the two oblique faces 39 and 40 and having enlarged terminal portions 61*a* to 67*a* and 68*a* to 74*a* respectively on the face 37, which are opposite but staggered with respect to each other according to the geometry shown in FIG. 12. The distance c between each conductor of the first group and the opposite ones of the second group is about 50μ. The width d of the terminal portions is identical for both groups and is about 350μ. The distance e between two contiguous terminal portions of the same group is 30 to 50μ. The width f of the conductors near the terminal zones is about 100μ. Above the opposed terminal portions 61*a* to 67*a* and 68*a* to 74*a* there is deposited, by the thick film technique, a strip 75 of several layers of resistive paste in thick film, extending perpendicular to the direction of the conductors over the whole zone in question of the terminal portions. The strip has its cylindrical curved surface which is not in contact with the face 37 with its concavity turned towards the face 37 (FIG. 13).

As an illustration, the conductors of each family are shown electrically connected (FIG. 11) through the switches 61*b* to 67*b* and 68*b* to 74*b* to opposite poles of a generator 76 of an electric potential of suitable value. Simultaneous closure for example of the switches 61*b* and 69*b* produces current flow in the circuit consisting of the conductors 61, 69 (FIG. 12) and of the zone 81 of the resistor strip 75 included between the facing parts of the terminal portions 61*a* and 69*a*. This current causes heating of the resistor paste located in the zone 81, thus defining a "hot point" of dimensions about 50μ × 150μ.

The arrangement of the conductors and the choice of their dimensions is such as to prevent heating up of the portions of the resistor strip adjacent to that selected. Since there are thirteen zones in which terminal portions of conductors of the first family are opposite terminal portions of the second family, it is eventually possible to single out in the strip of resistor paste 13 hot portions or hot points 80 to 92 which are selectively and individually thermally activable, which if desired may be phisically separated by transverse recesses 96 produced in the strip 75. With the dimensions shown it is clear that the technique of deposition does not call for greater precision than that required for the first two embodiments. The considerations cited above in regard to the positioning of the head relative to the registration medium, and its method of printing, are also valid. The two groups of conductors must be connected to a control and selecting circuit of generally known type, designed to activate, with the required delay, at each elementary printing act the portions 80 to 93 of the resistor strip required for printing the desired characters.

FIG. 1 shows in a partially exploded perspective view, a printing machine whose carriage is indicated generally by 47, which uses the first embodiment of the electrothermal head according to the invention for in-line printing of characters along a line of print.

FIG. 1 also shows the positioning device according to the second object of the invention.

The head is fixed for example by an adhesive on the surface 43 of a prismatic support 44 having a surface 100 opposite to the surface 43, and two flanks 101 and 102 extending perpendicularly to the surface 100. The surface 43 is inclined with respect to the surface 100 by an angle α corresponding to the one shown in the FIG. 3.

Provided in the two flanks 101 and 102 are two symmetrically located grooves 105 and 106 respectively, extending along the whole height of the support 44, two tapered projections 107 and 108 each having a first flat working portion 109 and a second flat working portion 110. A pair of guides 112 and 113 is bodily assembled on the flat portion 114 of the carriage 47. The guides 112 and 113 are suitable to engage the grooves 105 and 106 to allow the support 44 to slide thereon for its positioning with respect to the carriage 47. Two resilient elements 117 and 118, are bodily assembled on the flat portion 114 of the carriage 47 in parallel relation to the guides 112 and 113 and suitably spaced therefrom.

The free ends of the resilient elements 117 and 118 have a tapered shape provided with flat working portions 120 and 121 and are suitable to engage the lateral projections 107 and 108 for locking the support 44 onto the carriage 47. Secured to the flat portion 114 of the carriage 47 are furthermore eight resilent electrically conductive laminae 48 which are connected as already specified to the selection and control circuit of the printing thermoelements by means of the cable 49.

The tongues 48 are located so as to contact the end portions near the side 16, of the feed conductor 15 and of the return conductor 18 of the first head and to exert a pressure against the plate 10 owing to their resilence, so as to guarantee a good electric contact with said terminal portions, when the support 44 is placed on the carriage.

To place the support 44 onto the carriage 47, the grooves 105 and 106 should engage the guides 112 and 113, respectively, keeping the surface 43 facing the recording medium with the resistors 13 perpendicular to a line of print and then the support 44 should be displaced along the guides 105 and 106 as long as the base 124 of the support 44 contacts the flat portion 114 of the carriage 47.

During this displacing operation, when the flat working portions 110 of the projections 107 and 108 cooperate with the flat portions 120 of the free ends of the resilent elements 117 and 118, said elements 117 and 118 flex outwards, increasing the space from each other and allow the continuation of the displacing movement and the transit of the side projections 107 and 108 therebetween. When the surfaces 110 and 120 cease their reciprocal engaging, the resilient elements 117 and 118 are reset to their original position and the surfaces 121 of their free ends engage the surfaces 109 of the side projections 107 and 108, so as to push the support 44 to contact the flat portion 114 of the carriage 47 by its base 124 and to lock it fixedly thereon, as shown in dashed line in FIG. 1.

In the meantime the eight resilent laminae 48 are flexed by the support 44 and urged against the face 11 of the support 10 thus ensuring a fixed electric contact with the terminal portions of the conductors 15 and 18.

The head extraction operation is carried out by taking by hand the head and by pulling it upwards; owing to this movement, the engaging of the flat working portions 109 of the projections 107 and 108 with the flat portions 121 of the resilent elements 117 and 118 causes the latter to be flexed ouwards thus allowing the support to be displaced along the guides 112 and 113 and to be extracted.

The carriage 47 is mounted so that it can slide on a guide 50 extending transverse to the sheet of heat-sensitive paper 25 and fixed at opposite ends to the body 42; the carriage is also able to rotate about said guide and for this purpose cooperates with a bar 51 fixed to the body 42 and movable vertically.

Means for pulling the carriage in continuous motion along the guide are known in the art and are not indicated in the FIG. The sheet of heat-sensitive paper is fed from a reel 52 and pulled stepwise by the rollers 53 and 54, during each step the sheet being moved to a new printing line.

The sheet 25 is kept in contact, along the printing line, with a flat platen 55 fixed to the body 42. During movement of the carriage from left to right, with reference to FIG. 1, the bar 51 is in the position of the FIG., so that the head contacts the sheet of heat-sensitive paper 25 along the printing line and the operations of printing take place on it with formation of the characters 56.

When the carriage has completed its course towards the right the bar is moved vertically downwards so that the carriage is turned to the right and the printing head is withdrawn from the heat-sensitive paper, and the carriage can carry out its return run to the left free from any risk of catching the head on the paper. During the movement of the carriage to the left the sheet 25 is pulled by the rollers 53 and 54 and shifted to a new printing line.

The use of seven or thirteen resistor elements 13 or printing points, arranged in line and perpendicular to a line of print along the height of the character, is not to be regarded as a limiting example, either relative to their arrangement with respect to the recording medium or relative to the number of resistor elements used.

For example, the column of resistor elements 13 may be as long as a printing line on the registration means and may contain a number of resistor elements equal to a multiple n, (say 5) of the number of characters which can be printed on a printing line. The head is positioned in this case with the column of resistor elements 13 parallel to the printing line but perpendicular to the direction of the continuous pulling movement of the sheet. In this case the printing is of the "parallel" kind and during each elementary act of printing there is, if we consider characters printed with matrices of m rows for n columns, printing of one of the m rows of all characters in one line of print.

What we claim is:

1. A thermal print head for the non-impact printing of dot matrix characters on a heat sensitive medium comprising: a support provided with an electrically insulating surface, a single heating strip of resistive material on said surface, a pattern of conductors on said surface for selectively energizing and heating segments of said strip and including a first group of conductors extending transversely and spaced along one side of the strip and contacting the strip and a second group of conductors extending transversely and spaced along the other side of the strip and contacting the strip in an interleaved relationship to the conductors of the first group wherein each conductor of the second group is partly opposed to two adjacent conductors of the first group and each resistive segment of said strip lying between a given conductor of the first group and a given conductor of the second group is selectively heated upon application of an electric voltage between the given conductors.

2. An electrothermal printer for the non-impact printing of dot matrix characters on a heat sensitive medium comprising:

a thermal print head having a support provided with an electrically insulating surface, a single heating strip of resistive material on said surface, a pattern of conductors on said surface for selectively energizing and heating segments of said strip and including a first group of conductors extending transversely and spaced along one side of the strip and contacting the strip and a second group of conductors extending transversely and spaced along the other side of the strip and contacting the strip in an interleaved relationship to the conductors of the first group wherein each conductor of the second group is partly opposed to two adjacent conductors of the first group and each resistive segment of said strip lying between a given conductor of the first group and a given conductor of the second group is selectively heated upon application of an electric voltage between the given conductors;

a driving circuit for selectively energizing said segments;

a base member for mounting said head with said conductors electrically connected to said driving circuit; and means for positioning and removably fixing said head in said base member with said resistive strip in contact with the heat-sensitive medium.

3. An electrothermal printer according to claim 2 wherein said means for positioning and removably fixing comprises:

a plurality of conductive laminae for contacting the conductors of said patterns when said head is positioned in said base member, releasable latching means for latching said support to said base member, and manually operable means for releasing said latching means to remove said support from said base member.

4. An electrothermal printer according to claim 3 wherein said conductive laminae are resiliently mounted on said base member and slidably contact the conductors of said pattern when said support is moved into its latched position.

5. An electrothermal printer according to claim 3 wherein said releasable latching means comprises a pair of first latching members on said support and a pair of flexible arms mounted on said base member having second latching members and resiliently deformable to engage with said first latching members for latching said support to said base member.

* * * * *